US008133064B2

(12) United States Patent
Nishimura

(10) Patent No.: US 8,133,064 B2
(45) Date of Patent: Mar. 13, 2012

(54) ELECTRICAL POWER OUTLET

(75) Inventor: Yoji Nishimura, Tokyo (JP)

(73) Assignee: Furutech Co., Ltd., Tokyo (JP)

( * ) Notice: Subject to any disclaimer, the term of this patent is extended or adjusted under 35 U.S.C. 154(b) by 0 days.

(21) Appl. No.: 12/870,652

(22) Filed: Aug. 27, 2010

(65) Prior Publication Data

US 2011/0223788 A1 Sep. 15, 2011

(30) Foreign Application Priority Data

Mar. 12, 2010 (TW) ..... 99107206 A

(51) Int. Cl.
*H01R 4/66* (2006.01)

(52) U.S. Cl. ..... 439/107

(58) Field of Classification Search ..... 439/136, 439/107, 106, 839, 691, 650, 934; 174/66
See application file for complete search history.

(56) References Cited

U.S. PATENT DOCUMENTS 1,659,303 A * 2/1928 Rovere ..... 439/722
1,983,281 A * 12/1934 Fries et al. ..... 439/833
2,091,773 A * 8/1937 Travers ..... 439/535
2,214,065 A * 9/1940 Pennock et al. ..... 439/516
2,552,061 A * 5/1951 Popp ..... 439/136
2,969,518 A * 1/1961 Slater ..... 439/516
3,053,957 A * 9/1962 Duffield ..... 200/282
3,436,716 A * 4/1969 Amis, Jr. et al. ..... 439/232
3,467,941 A * 9/1969 Martin ..... 439/516
3,471,821 A * 10/1969 Cull ..... 439/80
3,569,902 A * 3/1971 Hara ..... 439/136
3,662,324 A * 5/1972 Schumacher ..... 439/839
3,718,894 A * 2/1973 Schumacher ..... 439/689
3,732,524 A * 5/1973 Reed et al. ..... 439/142
3,880,494 A * 4/1975 Reed et al. ..... 439/517
4,040,698 A * 8/1977 Ortiz ..... 439/136
4,105,862 A * 8/1978 Hoehn ..... 174/53
4,148,547 A * 4/1979 Otsuki et al. ..... 439/682
4,295,018 A * 10/1981 Borrelli ..... 200/51.09
4,435,032 A * 3/1984 Abramson et al. ..... 439/136
4,640,564 A * 2/1987 Hill ..... 439/137
4,733,017 A * 3/1988 Wolfe-Taylor et al. ..... 174/67
4,810,833 A * 3/1989 Meyers ..... 174/67
4,857,004 A * 8/1989 Poirier ..... 439/140
4,883,924 A * 11/1989 Hadfield ..... 174/482
4,952,756 A * 8/1990 Meyers ..... 174/67
5,160,808 A * 11/1992 Hadfield ..... 174/480
5,299,943 A * 4/1994 Shieh ..... 439/136
5,637,000 A * 6/1997 Osterbrock et al. ..... 439/107
5,727,958 A * 3/1998 Chen ..... 439/136
5,866,845 A * 2/1999 Markiewicz et al. ..... 174/57
5,934,919 A * 8/1999 Cross et al. ..... 439/136
5,998,734 A * 12/1999 Kerestan et al. ..... 174/53
6,109,937 A * 8/2000 Bonilla et al. ..... 439/107
6,175,078 B1 * 1/2001 Bambardekar et al. ..... 174/484

(Continued)

*Primary Examiner* — Tulsidas C Patel
*Assistant Examiner* — Vladimir Imas

(57) ABSTRACT

A power outlet includes a base and sliding covers. The base has conductive terminals for electrically connecting to terminals of a power line. The conductive terminals are partially exposed from the base and a pair of first guiding portions arranged in parallel to each other is disposed on each side of the base exposing the conductive terminals. Each of the sliding covers has second guiding portions capable of sliding with and engaging with the corresponding first guiding portions so as to allow the sliding covers to slide relative to the base, thereby shielding the exposed portions of the conductive terminals and preventing accidental touching of the exposed portions of the conductive terminals by a user and thus avoiding the risk of electric shock.

9 Claims, 6 Drawing Sheets

U.S. PATENT DOCUMENTS 6,265,662 B1 * 7/2001 Riedy et al. ..... 174/67
6,293,812 B1 * 9/2001 Ewer et al. ..... 439/107
6,552,262 B2 * 4/2003 English et al. ..... 174/485
6,790,084 B1 * 9/2004 Osborn et al. ..... 439/587
6,843,680 B2 * 1/2005 Gorman ..... 439/535
6,926,543 B2 * 8/2005 Poh et al. ..... 439/107
7,041,918 B1 * 5/2006 Wu ..... 200/51.09
7,077,706 B1 * 7/2006 Yang ..... 439/650
7,265,291 B1 * 9/2007 Gorman ..... 174/66
7,319,193 B2 * 1/2008 Halterman ..... 174/67
7,321,120 B1 * 1/2008 Gorman et al. ..... 250/338.1
7,357,652 B1 * 4/2008 Arenas et al. ..... 439/107
7,393,212 B2 * 7/2008 Parker ..... 439/8
7,544,941 B2 * 6/2009 Gorman et al. ..... 250/338.1
7,749,019 B2 * 7/2010 Valentin et al. ..... 439/538
2002/0016098 A1 * 2/2002 Poh et al. ..... 439/107
2003/0236011 A1 * 12/2003 Gorman ..... 439/107
2009/0236115 A1 * 9/2009 Li ..... 174/53

* cited by examiner

ELECTRICAL POWER OUTLET

BACKGROUND OF THE INVENTION

1. Field of the Invention

The present invention relates generally to power outlets, and, more particularly, to a power outlet capable of preventing accidental touching of the conductive terminals thereof, so as to significantly lower the risk of electric shock.

2. Description of Related Art

A power outlet, as shown in FIGS. 1 and 2 (PRIOR ART), generally has conductive terminals 1 disposed therein. Each of the conductive terminals 1 has a screw hole 11 and is covered by a fastening board 21. The fastening board 21 has an opening 213 formed therein corresponding in position to the screw hole 11 and a plurality of protruding portions 211 formed on the outward side thereof by pressing and facing towards the corresponding conductive terminal 1. The protruding portions 211 are used for pressing and covering a terminal 31 of a power line 3. A screw 23 is passed through the opening 213 of the fastening board 21 to engage with the screw hole 11 of the conductive terminal 1 so as to allow the fastening board 21 to be moved towards the conductive terminal 1, thereby securing the terminal 31 of the power line 3 between the protruding portions 211 and the conductive terminal 1. However, the protruding portions 211 are easy deformed under an external force, which reduces the contact area between the protruding portions 211 and the terminal 31 of the power line 3 and can even cause the terminal 31 to detach from the protruding portions 211, thereby leading to poor contact between the terminal 31 and the conductive terminal 1 and adversely affect the electrical conducting function of the power outlet. Further, since the screw 23, the fastening board 21 and the terminal 31 1 are partially exposed from the power outlet, the terminal 31 is easy detached from the fastening board 21 due to loosening of the screw 23, and/or the user may accidentally touch the exposed portions and experience electric shock.

Therefore, it is imperative to provide a more secure and safer power outlet so as to overcome the above drawbacks of the prior art.

SUMMARY OF THE INVENTION

In view of the above drawbacks of the prior art, an objective of the present invention is to provide a power outlet that can prevent accidental contact of the outlet by a user so as to significantly lower the risk of electric shock.

Another object of the present invention is to provide a power outlet so as to increase the contact stability between the terminals of a power line and the conductive terminals of the power outlet.

According to the above and other objectives, the present invention provides a power outlet, which comprises: a base having conductive terminals for electrically connecting to terminals of a power line, the conductive terminals being partially exposed from the base and a pair of first guiding portions arranged in parallel to each other being disposed on each side of the base exposing the conductive terminals; and sliding covers each having second guiding portions capable of sliding with and engaging with the corresponding first guiding portions so as to allow the sliding covers to slide relative to the base of the power outlet, thereby shielding the exposed portions of the conductive terminals.

Preferably, the first guiding portions are guiding slots and the second guiding portions of the sliding covers can be sliding with and embedded in the guiding slots. Each of the sliding covers has an operating portion disposed on the topside thereof so as for an external force to be applied thereon to cause the sliding cover to slide relative to the base of the power outlet. The operating portion has a concave shape, but it is not limited thereto. Each of the conductive terminals has a protruding portion facing the inside of the base of the power outlet, and the power outlet further comprises a fastening board and a screw, wherein the fastening board has a concave portion for engaging with the protruding portion of the conductive terminal, and the screw is passed through the conductive terminal and screwed with the fastening board so as to allow the fastening board to move relative to the conductive terminal, thereby establishing or releasing the electrical connection between the conductive terminal and terminal of the power line.

Preferably, each of the sliding covers has a second stopping portion disposed on the top side thereof, and the base of the power outlet has a first stopping portion disposed on the bottom side thereof, the first stopping portion and the second stopping portion jointly limiting the sliding displacement of the sliding cover relative to the base of the power outlet. The stopping portions are bumps, but they are not limited thereto.

Preferably, each of the conductive terminals has a plug connecting portion, which comprises a pair of longitudinal sheets and a lateral sheet disposed at one side of the pair of longitudinal sheets, the ends of the pair of longitudinal sheets extending in opposite directions, and the end of the lateral sheet extending in a direction opposite to the pair of longitudinal sheets. The plug connecting portion has a pair of fins disposed between the pair of longitudinal sheets and the lateral sheet. The plug connecting portion further has a holding spring disposed for applying an elastic holding force to the longitudinal sheets and the lateral sheet.

Therefore, the power outlet of the present invention comprises a base and sliding covers. The base has conductive terminals disposed therein for electrical connecting to terminals of a power line. The conductive terminals are partially exposed from the base, and a pair of guiding portions arranged in parallel to each other is disposed on each side of the base exposing the conductive terminals. Each of the sliding covers has second guiding portions capable of slidingly engaging with the corresponding first guiding portions so as to allow the sliding covers to slide relative to the base, thereby shielding the exposed portions of the conductive terminals and preventing accidental touching of the exposed portions of the conductive terminals by a user so as to avoid the risk of electric shock.

The power outlet further comprises fastening boards with a concave portion. Each of the conductive terminals has a protruding portion corresponding to the concave portion. Through engagement of the protruding portions of the conductive terminals and the concave portions of the fastening boards, the contact area between the terminals of the power line and the conductive terminals is increased so as to prevent the terminals of the power line from releasing from the power outlet and increase the contact stability between the terminals of the power line and the conductive terminals of the power outlet.

DETAILED DESCRIPTION OF PREFERRED EMBODIMENTS

The following illustrative embodiments are provided to illustrate the disclosure of the present invention and its advantages, these and other advantages and effects being readily apparent to those in the art after reading this specification.

Figure 1:
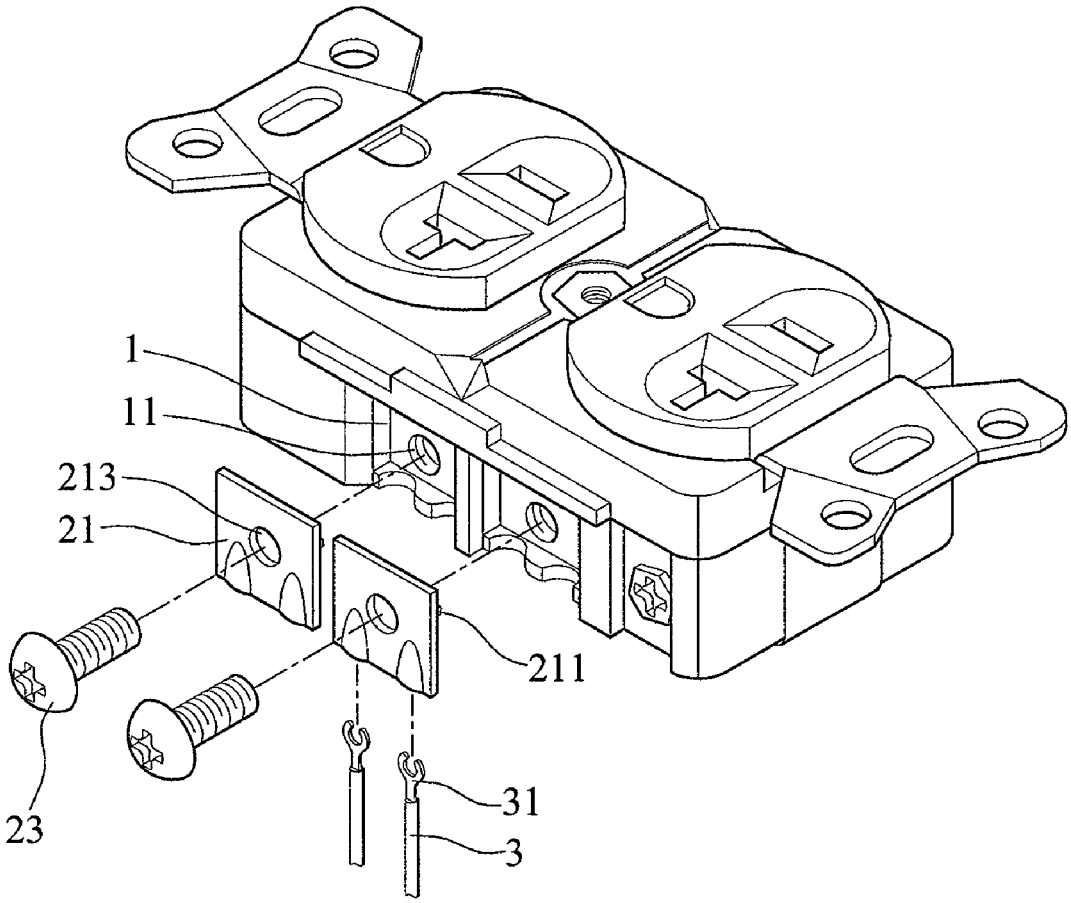
FIG. 1 (PRIOR ART)
FIG. 1 (PRIOR ART) is an exploded view of a conventional power outlet.
Figure 2:
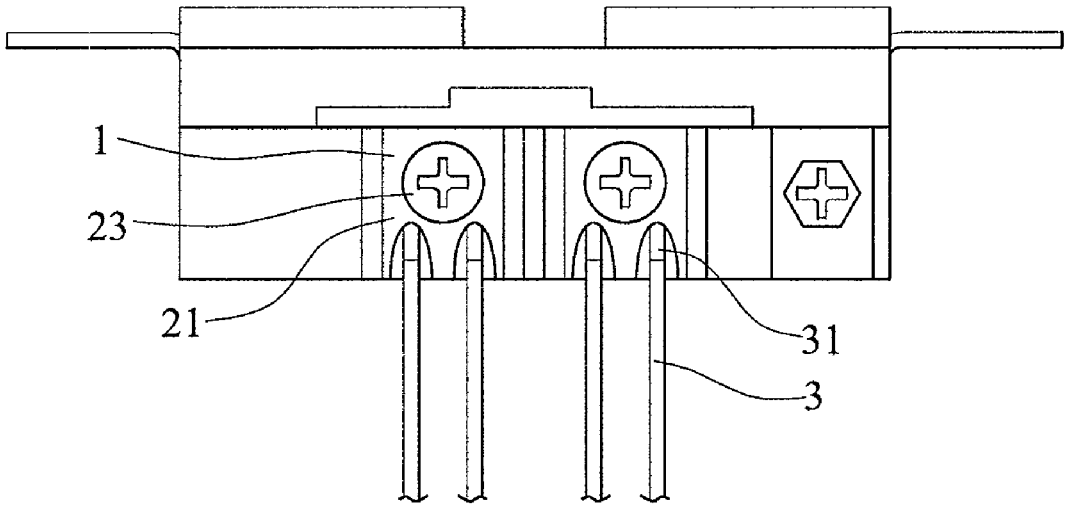
FIG. 2 (PRIOR ART)
FIG. 2 (PRIOR ART) is a front view of the conventional power outlet after assembly.
Figure 3:
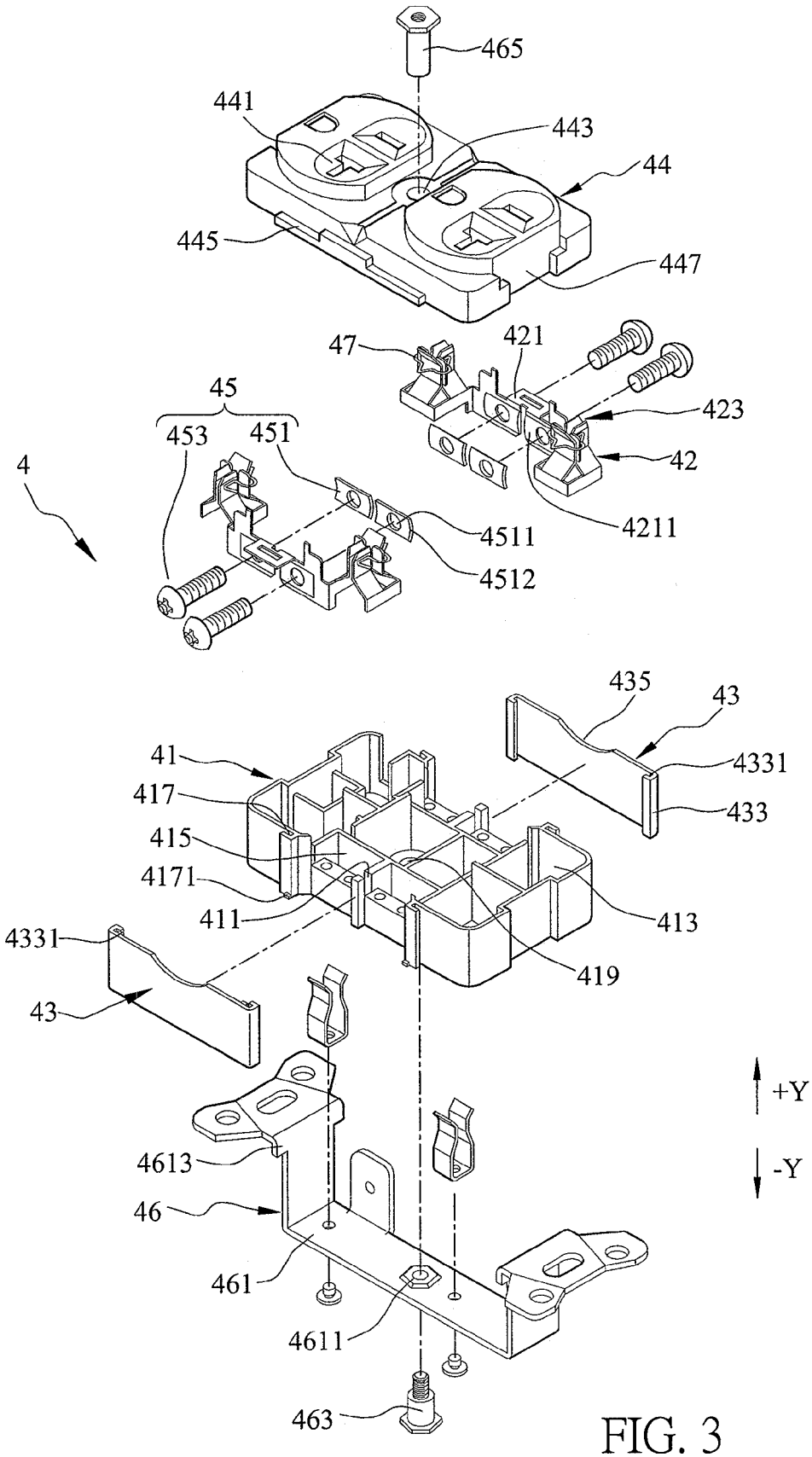
FIG. 3 is an exploded view of a power outlet according to an embodiment of the present invention.
Figure 4:
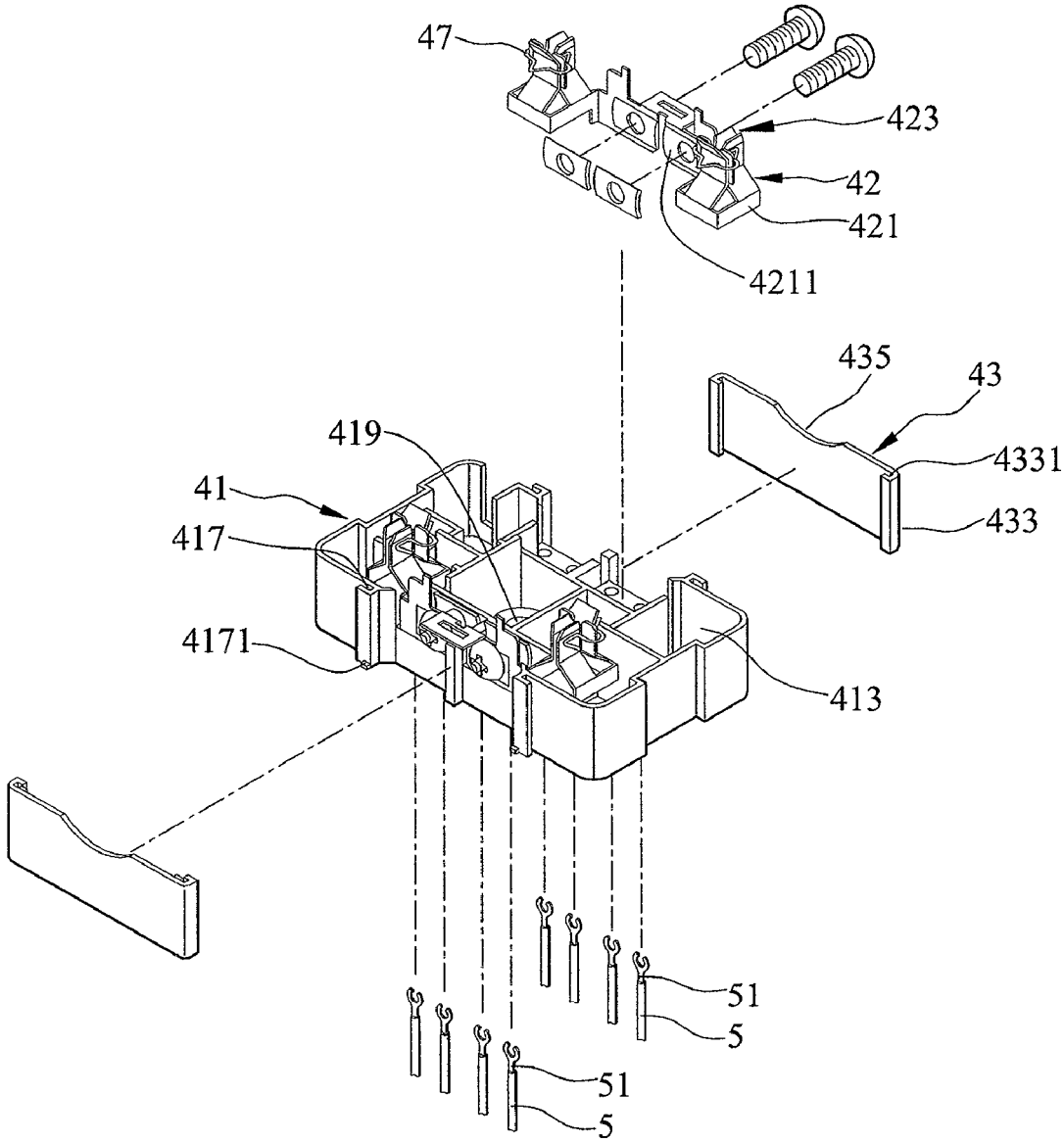
FIG. 4 is a partially assembled view of the power outlet of FIG. 3.

FIGS. 3 and 4 show an exploded view and a partially assembled view of a power outlet according to an embodiment of the present invention. Referring to FIGS. 3 and 4, the power outlet 4 comprises a base 41, conductive terminals 42, sliding covers 43, a cover body 44, locking units 45 and an elastic unit 46. It should be noted that the shape and number of the above-described components can be varied according to the practical needs and are not limited to those shown in the drawings.

The conductive terminals 42 are disposed in the base 41 for electrically connecting to terminals 51 of a power line 5. Therein, the conductive terminals 42 are partially exposed from the base 41, and a pair of first guiding portions 417 arranged in parallel to each other is disposed on each side of the base 41 leaving the conductive terminals 42 exposed. Each of the sliding covers 43 has second guiding portions 433 capable of sliding with and engaging with the corresponding first guiding portions 417 so as to allow the sliding covers 43 to slide relative to the base 41, thereby shielding the exposed portions of the conductive terminals 42 and preventing accidental touching of the conductive terminals by a user and thus avoiding the risk of electric shock.

In the present embodiment, the guiding portions 417, 433 are guiding slots, but are not limited thereto. In addition, the second guiding portions 433 are inserted into the first guiding portions 417 in a direction indicated by an arrow −Y in FIG. 3 so as to allow the sliding covers 43 to slide along the directions −Y and +Y in FIG. 3. Further, each of the sliding covers 43 has a second stopping portion 4331 disposed on the top side thereof, and the base 41 has a first stopping portion 4171 disposed at the bottom side thereof. The first and second stopping portions 4171, 4331 jointly stop sliding of the sliding covers 43 along the direction −Y so as to limit the sliding displacement of the sliding covers 43 on the base 41, thereby avoiding detachment of the sliding covers 43 from the base 41 along the direction −Y. It should be noted that the positions of the stopping portions 4171, 4331 can be varied. In addition, the stopping portions 4171, 4331 are bumps in the present embodiment, but are not limited thereto.

Further, each of the sliding covers 43 has an operating portion 435 disposed at the central portion of the top side thereof so as for a maintenance person to apply force on the sliding covers 43 using fingers or tools, thereby causing the sliding covers 43 to slide relative to the base 41. It should be noted that the position of the operating portion 435 can be varied according to the practical needs. In the present embodiment, the operating portion 435 has a concave shape, but it is not limited thereto.

In the present embodiment, each of the conductive terminals 42 at least comprises a base 421 and a plug connecting portion 423. Therein, the base 421 has a protruding portion 4211 disposed facing the inside of the base 421. The plug connecting portion 423 has an insertion hole disposed according to the standard specification of an electrical appliance plug so as for the electrical appliance plug to be inserted therein. The conductive terminals 42 can be made of pure copper so as to improve the electrical conductivity thereof. Alternatively, the conductive terminals 42 can be made of other materials having good electrical conductivity.

The base 41 of the power outlet further comprises embedding portions 411, receiving portions 413 and openings 415. Therein, the embedding portions 411 are portions, such as slots, through which the conductive terminals 42 can be embedded in the base 41. The receiving portions 413 have a concave shape for receiving the plug connecting portions 423 of the conductive terminals 42. The openings 415 are disposed at sides of the embedding portions 411, respectively, so as to expose particular portions of the base 41 of the power outlet and/or the conductive terminals 42, thereby simplifying the assembly of the power outlet 4. In addition, the base 41 of the power outlet has a first connecting hole 419 disposed at the central portion thereof so as to allow the elastic unit 46 to be connected to the base 41. However, the connecting mechanism is not limited thereto and any other suitable connecting mechanism can be used.

The cover body 44 is disposed on the base 41 of the power outlet and has insertion holes 441 and a second connecting hole 443, wherein the insertion holes 441 correspond in position to the plug connecting portions 423, respectively. In the present embodiment, the second connecting hole 443 is disposed at the central portion of the cover body 44 to correspond in position to the first connecting hole 419. But it should be noted that the number, position and arrangement of the insertion holes 441 and the second connecting hole 443 can be varied according to the practical needs.

Figure 5:
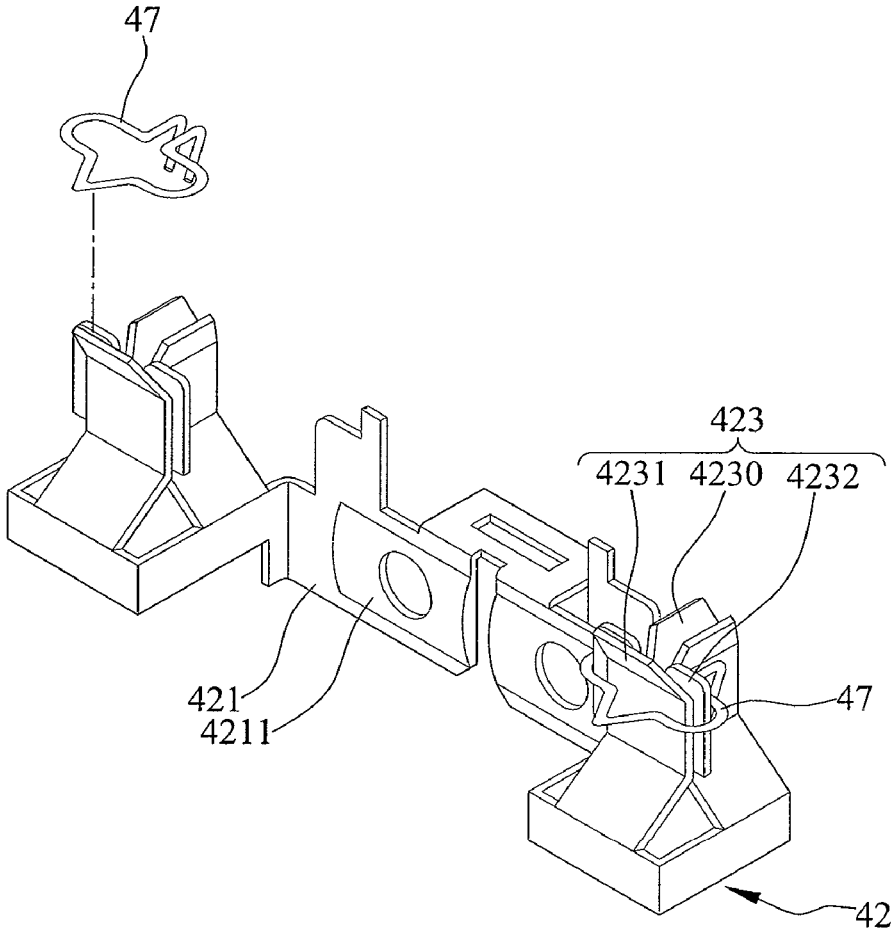
FIG. 5 is an assembled view of conductive terminals of the power outlet of FIG. 3.

FIG. 5 is an assembled view of the conductive terminals 42 of the power outlet 4 of FIG. 3. In the present embodiment, each of the plug connecting portions 423 comprises a pair of longitudinal sheets 4230 facing each other and a lateral sheet 4231 disposed at one side of the pair of longitudinal sheets 4230. Therein, the end of each of the longitudinal and lateral sheets 4230, 4231 corresponding in position to the insertion hole 441 of the cover body 44 extends outwards so as to form a guiding structure that is wide at the top. That is, the ends of the pair of longitudinal sheets 4230 extend outwards in opposite directions, and the end of the lateral sheet 4231 extends outwards in a direction opposite to the pair of longitudinal sheets 4230.

Further, each of the plug connecting portions 423 has a pair of fins 4232 disposed between the pair of longitudinal sheets 4230 and the lateral sheet 4231. In the present embodiment, the fins 4232 are formed by bending one side of the longitudinal sheets 4230. That is, the longitudinal sheets 4230 extend outwards along the lateral sheet 4231, respectively, so as to smoothly guide a plug blade into the plug connecting portion 423, thereby preventing the plug blade from being scratched by the conductive terminal 42.

Furthermore, the power outlet 4 comprises holding springs 47 disposed around the plug connecting portions 423, respectively, so as to apply an elastic holding force to the longitudinal sheets 4230 and the lateral sheet 4231, thus preventing deformation of the plug connecting portions 423 after multiple uses and accordingly preventing poor electrical contact between the plug and the plug connecting portions 423.

Also, the cover body 44, as shown in FIG. 3, further comprises: third stopping portions 445 disposed on both longitudinal sides thereof for limiting the sliding displacement of the sliding covers 43 along the direction +Y, and a connecting portion 447 on each end for connecting the cover body 44 with the base of the power outlet.

Each of the locking units 45 comprises a fastening board 451 and a screw 453. The fastening board 451 is attached to one side of the base 421 of the corresponding conductive terminal 42. Therein, the fastening board 451 has a concave portion 4512 for engaging with the protruding portion 4211 of the conductive terminal 42 and further has a screw hole 4511 corresponding to the screw 453. The screw 453 is passed through the opening 415 of the base 41 so as to be screwed with the screw hole 4511, thereby connecting the conductive terminal 42 with the fastening board 451. As such, the fastening board 451 can be moved forward or backward relative to the conductive terminal 42, thereby establishing or releasing electrical connection between the conductive terminal and the terminal 51 of the power line 5. It should be noted that the engagement between the concave portion 4512 of the fastening board 451 and the protruding portion 4211 of the conductive terminal 42 increases the contact area between the terminal 51 of the power line 5 and the conductive terminal 42 so as to prevent the terminal 51 from releasing from the power outlet 4 and increase the contact stability between the terminals 51 of the power line 5 and the conductive terminals 42 of the power outlet 4.

The elastic unit 46, as shown in FIG. 3, comprises an elastic member 461, a locking member 463 and a fastening member 465 (shown above the cover body 44). Therein, the fastening member 465 is received in the second connecting hole 443 of the cover body 44. The elastic member 461 is made of a flexible conductive material. The elastic member 461 has a third connecting hole 4611 corresponding in position to the first connecting hole 419 of the base 41 and a connecting portion 4613 for engaging with the connecting portion 447 of the cover body 44 so as to secure the cover body 44 to the base 41. The locking member 463 is passed in sequence through the third connecting hole 4611 and the first connecting hole 419 so as to engage with the fastening member 465. Thus, the power outlet 4 is complete. In the present embodiment, the locking member 463 is a locking screw, and the fastening member 465 is a screw cap corresponding to the locking screw, but they are not limited thereto.

Figure 6:
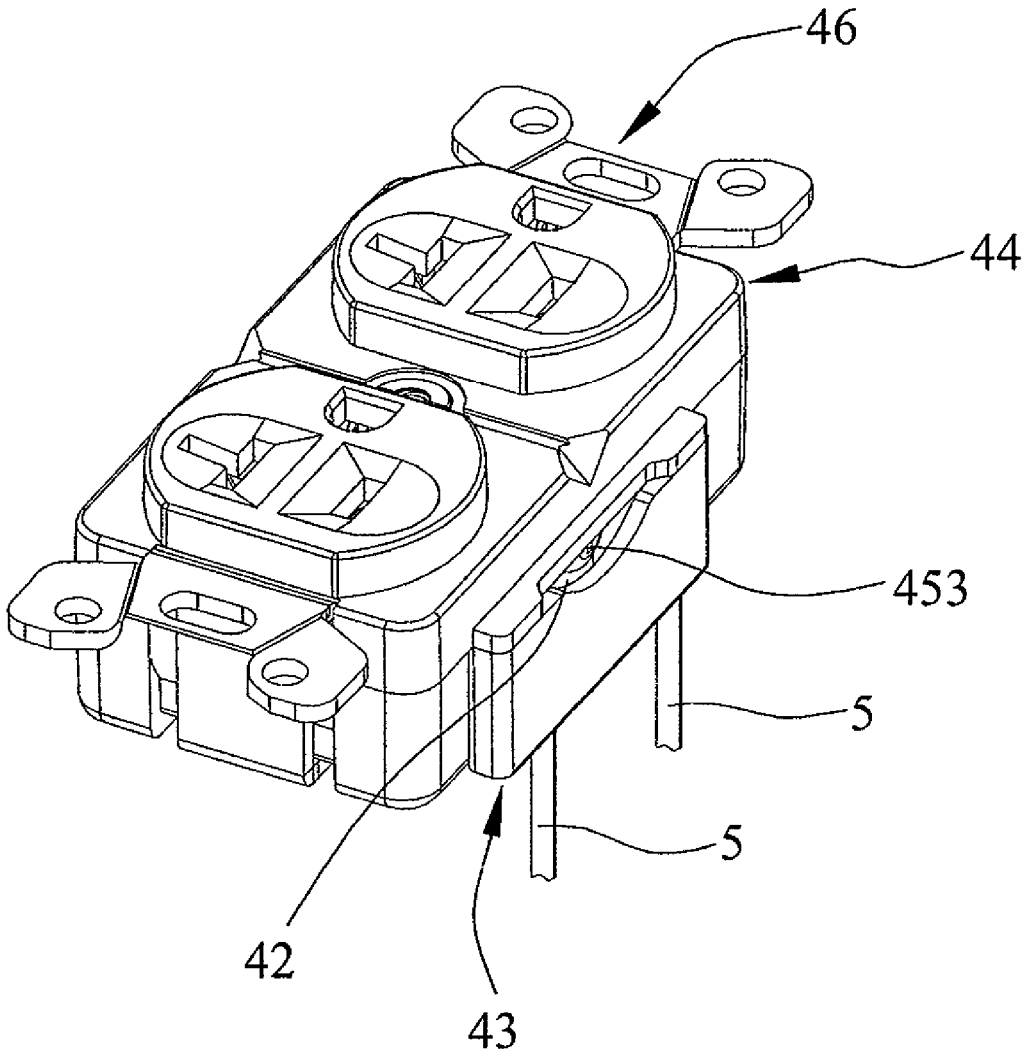
FIG. 6 is a perspective view of the power outlet of FIG. 3 after assembly.

FIG. 6 shows an assembled view of the power outlet of FIG. 3. Referring to FIG. 6 and FIG. 4, the power line 5 is disposed between the fastening boards 451 and the protruding portions 4211 of the bases 421 of the conductive terminals, and the conductive terminals 42 and the fastening boards 451 are connected through the screws 453, thereby establishing electrical connection between the power line 5 and the power outlet 4. Then, the guiding portions 417, 433 are engaged with each other so as to allow the sliding covers 43 to be slid relative to the base of the power outlet, thus shielding the exposed portions of the conductive terminals and preventing accidental touching of the exposed portions of the conductive terminals by a user so as to avoid the risk of electric shock.

Therefore, the power outlet of the present invention comprises a base and sliding covers. The base has conductive terminals disposed therein for electrical connecting to terminals of a power line. The conductive terminals are partially exposed from the base, and a pair of guiding portions arranged in parallel to each other is disposed on each side of the base exposing the conductive terminals. Each of the sliding covers has second guiding portions capable of sliding with and engaging with the corresponding first guiding portions so as to allow the sliding covers to slide relative to the base, thereby shielding the exposed portions of the conductive terminals and preventing accidental touching of the exposed portions of the conductive terminals by a user so as to avoid the risk of electric shock.

The power outlet further comprises fastening boards, each with a concave portion. Each of the conductive terminals has a protruding portion corresponding to the concave portion. Through engagement of the protruding portions of the conductive terminals and the concave portions of the fastening boards, the contact area between the terminals of the power line and the conductive terminals is increased so as to prevent the terminals of the power line from releasing from the power outlet and increase the contact stability between the terminals of the power line and the conductive terminals of the power outlet.

The above-described descriptions of the detailed embodiments are provided to illustrate the preferred implementation according to the present invention, and are not intended to limit the scope of the present invention. Accordingly, many modifications and variations completed by those with ordinary skill in the art can be made and yet still fall within the scope of present invention defined by the appended claims.

What is claimed is:

1. A power outlet, comprising:

a base having conductive terminals for electrically connecting to terminals of a power line, the conductive terminals being partially exposed from the base and a pair of first guiding portions arranged in parallel to each other being disposed on each side of the base exposing the conductive terminals, wherein each of the conductive terminals has an inner surface and an outer surface, and the inner surface is a protruding surface facing an inside of the base of the power outlet;

a plurality of fastening boards and screws, wherein each of the fastening boards has a concave portion for engaging with the protruding surface of a corresponding one of the conductive terminals, and the screw is passed through a corresponding one of the conductive terminals and screwed with a corresponding one of the fastening boards and contacted with the outer surface of the corresponding one of the conductive terminals so as to allow the corresponding one of the fastening boards to move relative to the corresponding one of the conductive terminals, thereby establishing or releasing the electrical connection between the conductive terminals and the of power line; and sliding covers each having second guiding portions capable of sliding with and engaging with the corresponding first guiding portions so as to allow the sliding covers to slide relative to the base of the power outlet, thereby shielding the exposed portions of the conductive terminals.

2. The outlet of claim 1, wherein the guiding portions are guiding slots engaging with each other.

3. The outlet of claim 1, wherein each of the sliding covers has an operating portion disposed on a top side thereof so as for an external force to be applied thereon to cause the sliding cover to slide relative to the base of the power outlet.

4. The outlet of claim 3, wherein the operating portion has a concave shape.

5. The outlet of claim 1, wherein each of the sliding covers has a second stopping portion disposed on a top side thereof and the base of the power outlet has a first stopping portion disposed on a bottom side thereof, the first stopping portion and the second stopping portion jointly limiting a sliding displacement of the corresponding sliding cover relative to the base of the power outlet.

6. The outlet of claim 5, wherein the stopping portions are bumps.

7. The outlet of claim 1, wherein each of the conductive terminals has a plug connecting portion, which comprises a pair of longitudinal sheets and a lateral sheet disposed at one side of the pair of longitudinal sheets, ends of the pair of longitudinal sheets extending in an opposite direction, and an end of the lateral sheet extending in a direction opposite to the pair of longitudinal sheets.

8. The outlet of claim 7, wherein the plug connecting portion has a pair of fins disposed between the pair of longitudinal sheets and the lateral sheet.

9. The outlet of claim 8, wherein the plug connecting portion has a holding spring disposed for applying an elastic holding force to the longitudinal sheets and the lateral sheet.

* * * * *